US010052256B2

(12) United States Patent
Wang

(10) Patent No.: US 10,052,256 B2
(45) Date of Patent: Aug. 21, 2018

(54) VIBRATION RING

(71) Applicants: Ming-Huei Wang, Taipei (TW); Chien-Feng Lin, New Taipei (TW)

(72) Inventor: Ming-Huei Wang, Taipei (TW)

(73) Assignee: Ming-Huei Wang, Taipei (TW)

( * ) Notice: Subject to any disclaimer, the term of this patent is extended or adjusted under 35 U.S.C. 154(b) by 166 days.

(21) Appl. No.: 14/993,201

(22) Filed: Jan. 12, 2016

(65) Prior Publication Data

US 2017/0042757 A1 Feb. 16, 2017

(30) Foreign Application Priority Data

Aug. 13, 2015 (TW) ..... 104213075 U

(51) Int. Cl.
*A61H 19/00* (2006.01)
*A61H 23/02* (2006.01)

(52) U.S. Cl.
CPC ..... *A61H 19/32* (2013.01); *A61H 19/34* (2013.01); *A61H 19/50* (2013.01); *A61H 23/02* (2013.01); *A61H 2201/0188* (2013.01); *A61H 2201/165* (2013.01)

(58) Field of Classification Search
CPC ..... A61H 19/32; A61H 19/34; A61H 19/50; A61H 2201/0188; A61H 2201/165; A61H 23/02
See application file for complete search history.

(56) References Cited

U.S. PATENT DOCUMENTS

2006/0178602 A1* 8/2006 Teng ..... A61H 19/34 601/70
2009/0012355 A1* 1/2009 Lin ..... A61H 19/34 600/41
2010/0010292 A1* 1/2010 Talbot ..... A61H 19/34 600/38
2011/0288370 A1* 11/2011 Orten ..... A61F 5/41 600/38
2013/0109914 A1* 5/2013 Imboden ..... A61H 1/00 600/38

* cited by examiner

*Primary Examiner* — Christine H Matthews
(74) *Attorney, Agent, or Firm* — Jackson IPG PLLC; Demian K. Jackson

(57) ABSTRACT

A vibration ring includes a vibration module and a latex ring. The vibration module is provided with at least a battery, a circuit board and a vibration motor that are connected electrically in a spherical shell, along with a switch that is exposed out of the shell. The latex ring includes an annular wearing part that is processed with latex, and a spherical vibration part that encloses the shell of the vibration module. The spherical vibration part and the enclosed vibration module act onto a female's clitoris without pressing on other parts of the body, so as to increase the comfortableness in wearing the vibration ring and form a better exciting effect in vibration.

8 Claims, 9 Drawing Sheets

VIBRATION RING

BACKGROUND OF THE INVENTION a) Field of the Invention

The present invention relates to a vibration ring, and more particularly to a vibration ring that can be worn more comfortably and can form a better exciting effect in vibration.

b) Description of the Prior Art

It is well known that there are a lot of reasons for a male and a female to have a harmonious love relationship, and the most important one is about treating each other with mutual respect and true heart. However, the sweet talk in bed is also part of the ways for maintaining happiness and it is indeed very nice if both of the abovementioned factors can be accounted for. In reality, either the male has some problems that cannot be told or he has a strong self-ego to have sex for obligation without even considering the feeling of the female, or the female feels burnout in having sex as she cannot be satisfied.

Accordingly, many tools for improving the temperament have shown up in the markets, such as a ring that can be used to improve the temperament. The ring is made of latex and is fastened properly on a neck part of a male genital organ. In addition, a protruded part vertical to the ring is disposed at any location on the latex ring, so that when the ring is sheathed on the neck part of the male genital organ, the protruded part can be exactly disposed on an upper end of the male genital organ, allowing blood in hyperemic veins of the male genital organ to flow back slowly, which achieves the effect of prolonging the hyperemia.

Furthermore, when the male and the female are having sex, the protruded part can be abutted exactly at the clitoris of the female to acquire a proper effect of touching and massaging. Therefore, the hyperemia can be prolonged to the male and the female can be satisfied easily.

In a prior art, an interior of the protruded part can be further provided with a vibration module by which a vibration effect can act onto the female's clitoris, thereby increasing the sense of excitement and improving the fun in having sex to the female.

In the conventional vibration ring with the vibration function, the protruded part is mostly a transversal round tube and the vibration module includes a vibration motor, a circuit board, a battery and a switch that are integrated in a long shell, with that the vibration module is installed on the protruded part of the ring by inserting the entire shell into the protruded part. Nevertheless, for this kind of structure design, as both ends of the vibration ring will be protruded excessively, it will be unable to form the expected vibration effect to the female's clitoris and both the male and the female will feel uncomfortable while actually using the vibration ring.

SUMMARY OF THE INVENTION

Accordingly, the primary object of the present invention is to disclose a vibration ring that can be worn more comfortably and can form a better exciting effect in vibration.

The vibration ring of the present invention includes primarily a vibration module and a latex ring. The vibration module is constituted by a battery, a circuit board and a vibration motor that are connected electrically in a spherical shell, along with a switch that is exposed out of the shell and is connected electrically with the circuit board. The latex ring is provided with an annular wearing part that is processed with latex, and a spherical vibration part that encloses the shell of the vibration module.

By the abovementioned structures, when the vibration ring of the present invention is in use, the wearing part of the latex ring is fastened on a neck part of a male genital organ properly and when the male and the female are having sex, the vibration part and the enclosed vibration module can be abutted at the female's clitoris, thereby acquiring a proper effect of touching and massaging. In addition, under the condition that the vibration module is activated, the vibration effect acting onto the female's clitoris is formed by the vibration module, which improves the sense of excitement and increases the fun in having sex to the female. In particular, as the entire vibration part that acts onto the female's clitoris and the enclosed vibration module are all spherical, they will not press on other parts of the body, which increases the comfortableness in wearing the vibration ring and forms the better exciting effect in vibration.

More specifically, in the vibration ring disclosed by the present invention, the spherical vibration part and the enclosed vibration module act onto the female's clitoris, avoiding pressing on other parts of the body. Therefore, the vibration ring can be worn on the male genital organ more comfortably and the better exciting effect in vibration can be formed. Moreover, with the jumping effect formed by a ball or the swinging effect formed by the vibration motor, an irregular exciting effect can be produced to the area of contact, which improves the sense of excitement to the users in a more aggressive and reliable means.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
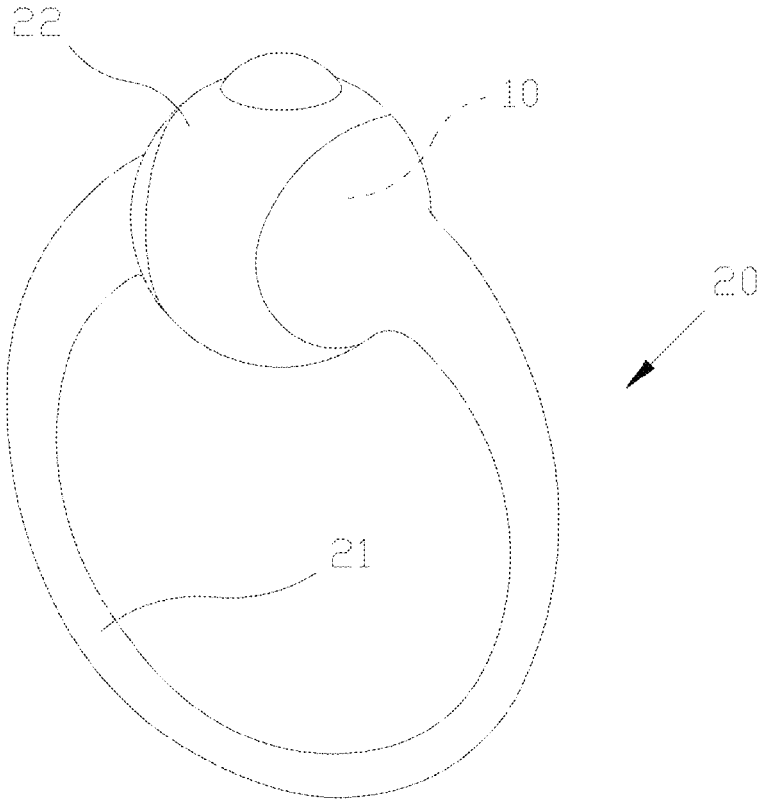
FIG. 1 shows a three-dimensional view of the appearance of a vibration ring, according to the present invention.
Figure 2:
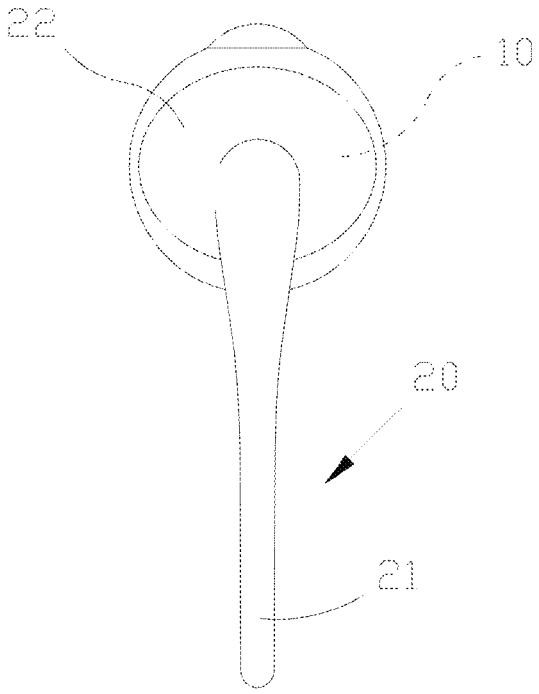
FIG. 2 shows a side view of the vibration ring, according to the present invention.
Figure 3:
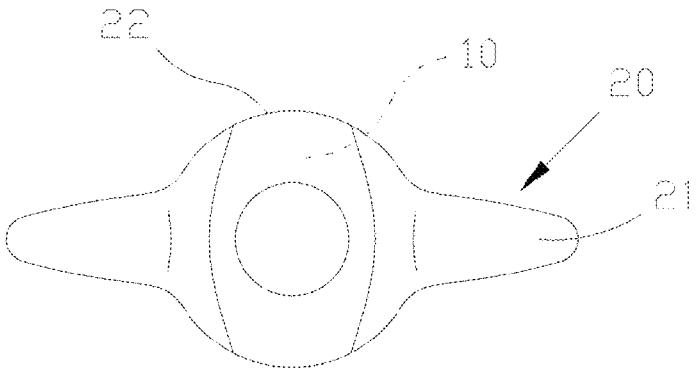
FIG. 3 shows a bottom view of the vibration ring, according to the present invention.

The present invention discloses primarily a vibration ring that can be worn more comfortably and can form a better exciting effect in vibration. As shown in FIGS. 1 to 4, the vibration ring of the present invention comprises basically a vibration module 10 and a latex ring 20.

The vibration module 10 includes at least a battery 12, a circuit board 13 and a vibration motor 14 that are connected electrically in a spherical shell 11, along with a switch 15 that is exposed out of the shell 11 and is connected electrically with the circuit board 13. The switch 15 controls the ON/OFF of the circuit between the vibration motor 14 and the battery 12, and changes the vibration mode and the vibration frequency that the circuit board 13 uses to drive the vibration motor 14 through touching the switch 15 repeatedly.

Figure 4:
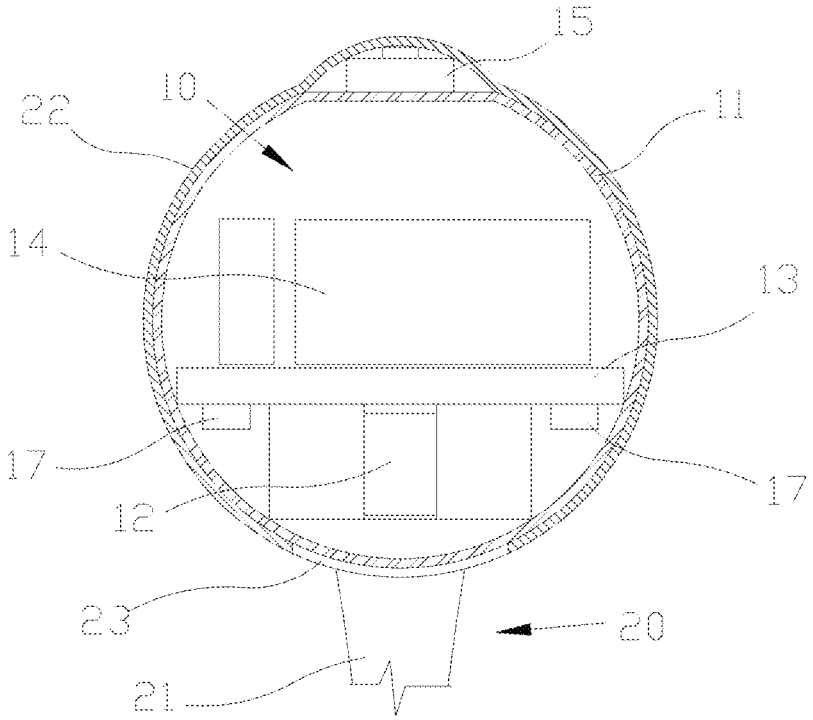
FIG. 4 shows a cutaway view of a first embodiment of the vibration ring, according to the present invention.

The latex ring 20 is provided with an annular wearing part 21 that is processed with latex, and a spherical vibration part 22 that encloses the shell 11 of the vibration module 10. In implementing, the said vibration module 10 can be enclosed integrally by the vibration part 22 during the procedure of processing the latex ring 20. It is of course that for the said latex ring 20 as shown in FIG. 4, a side of the vibration part 22 can be provided with an opening 23, with that the aperture of the opening 23 is smaller than the outer diameter of the shell 11, which allows the entire vibration module 10 to be inserted into the vibration part 22 through the opening 23.

In principle, when the vibration ring of the present invention is in use, the wearing part 21 of the latex ring 20 is fastened properly on the neck part of the male genital organ; whereas, the vibration part 22 and the enclosed vibration module 10 are abutted at the female's clitoris to acquire the proper effect of touching and massaging, when the male and the female are having sex. In addition, under the condition that the vibration module 10 is activated, the vibration module 10 can result in the vibration effect that acts on the female's clitoris, so as to increase the sense of excitement and improve the fun in having sex to the female.

In particular, as the entire vibration part 22 that acts onto the female's clitoris and the enclosed vibration module 10 are all spherical, they will not press on other parts of the body, which increases the comfortableness in wearing the vibration ring and forms the better exciting effect in vibration.

Figure 5:
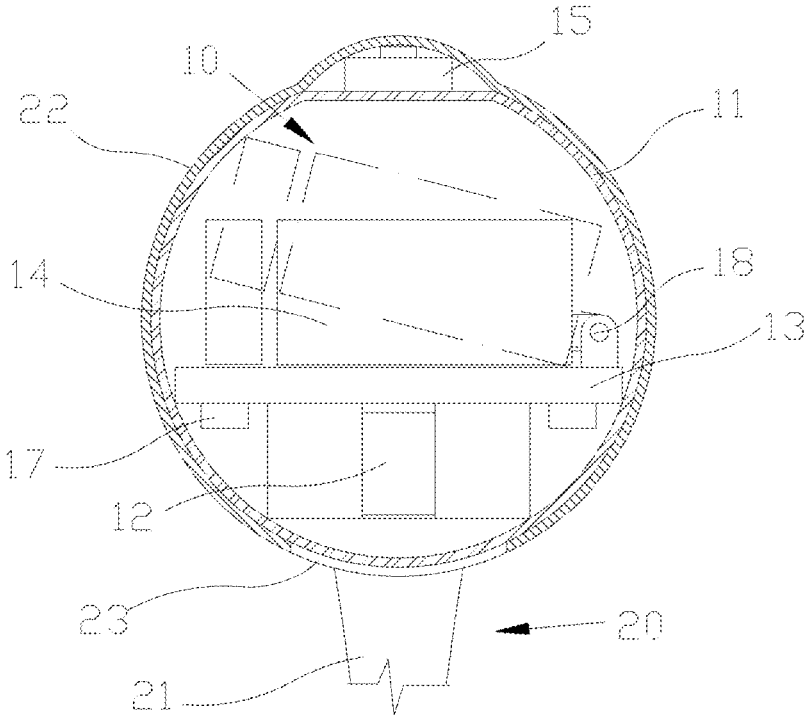
FIG. 5 shows a cutaway view of a second embodiment of the vibration ring, according to the present invention.
Figure 6:
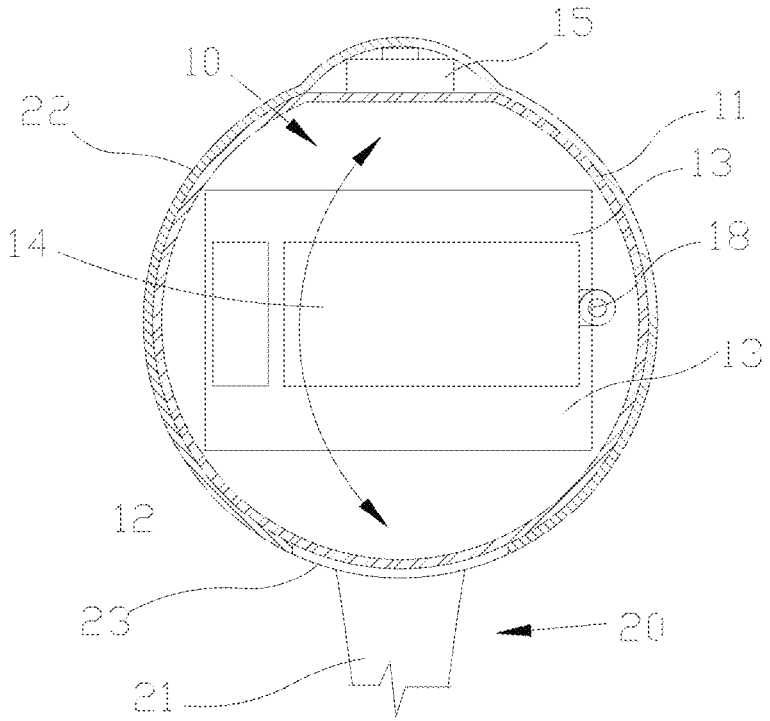
FIG. 6 shows a cutaway view of a third embodiment of the vibration ring, according to the present invention.

Referring to FIG. 5, the vibration motor 14 of the present invention can also swing freely, with an end of the vibration motor 14 being connected with the circuit board 13 to form a pivot 18. By the swinging effect produced by the vibration motor 14, an irregular exciting effect can be formed at the area of contact. Furthermore, the vibration motor 14 rotates up-and-down alternatingly relative to the circuit board 13 against the pivot 18 to hit the shell 11 repeatedly, thereby achieving a stronger vibration effect to improve the user's sense of excitement in a more aggressive and reliable means. On the other hand, as shown in FIG. 6, the vibration motor 14 can also rotate alternatingly in a horizontal direction relative to the circuit board 13 against the pivot 18 to hit the shell 11 repeatedly, thereby achieving a stronger vibration effect to improve the user's sense of excitement in a more aggressive and reliable means.

Figure 7:
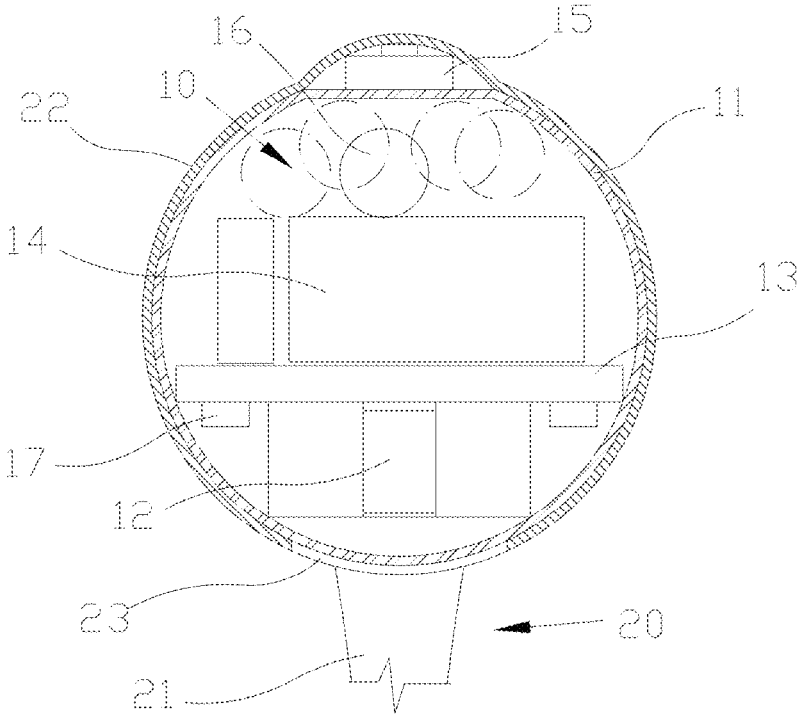
FIG. 7 shows a cutaway view of a fourth embodiment of the vibration ring, according to the present invention.

Referring to FIG. 7, for the vibration module 10 of the present invention, an interior of the shell 11 is provided with at least a ball 16 that jumps inside the shell 11 by the vibration motor 14, so that by the jumping of the ball 16, an irregular exciting effect can be formed at the area of contact, thereby improving the user's sense of excitement in a more aggressive and reliable means.

Under all kinds of structure types that can be implemented as described above, in the said vibration module 10, the circuit board 13 can be further connected electrically with at least a light emitting diode 17, the shell 11 can be processed into a spherical ball with a transparent material, and the latex ring 20 can be processed with transparent latex. Similarly, by touching the switch 15 repeatedly, the lighting mode that the circuit board 13 uses to drive the light emitting diode 17 can be changed, thereby increasing the visual effect in using the vibration ring.

It is of course that under all kinds of structure types that can be implemented as described above, in the said vibration module 10, the circuit board 13 can be further connected electrically with at least a light emitting diode 17, the shell 11 can be processed into a spherical ball with a transparent material, and the latex ring 20 can be processed with transparent latex. In addition, a side of the vibration part 22 can be further provided with an opening 23, with that the aperture of the opening 23 is smaller than the outer diameter of the shell 11.

Figure 8:
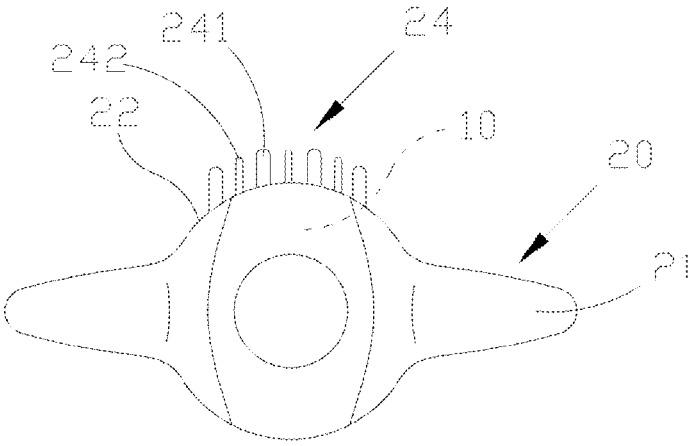
FIG. 8 shows a cutaway view of a fifth embodiment of the vibration ring, according to the present invention.

Moreover, as shown in FIG. 8, under all kinds of structure types that can be implemented as described above, in the vibration ring of the present invention, an exterior of the vibration part 22 can be installed with plural columns 24. These columns 24 can be thick columns 241 made of an elastic and tough material, thin columns 242 made of a soft and elastic material, or thick columns 241 made of an elastic and tough material and thin columns 242 made of a soft and elastic material that are distributed alternatingly. By these thick columns 241 and thin columns 242 touching the female's clitoris to interact with the neck part of the male genital organ, the exciting effect in vibration at a proper location can be achieved, thereby further improving the sense of excitement between the male and female to increase the fun in having sex.

Figure 9:
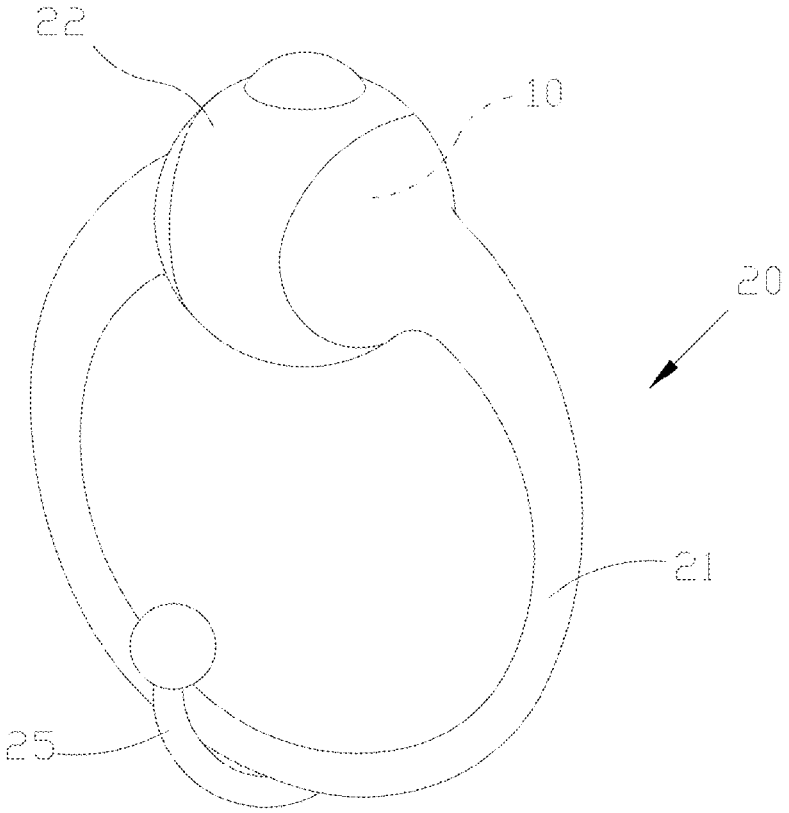
FIG. 9 shows a structural view of a sixth embodiment of the vibration ring, according to the present invention.

Furthermore, as shown in FIG. 9, the wearing part 21 is provided with a hook part 25 which can be hung up on an ear of the user as a decoration in the present invention. As the latex ring 20 can emit colorful light, the decoration can manifest a flashing effect.

In comparison with the prior art, for the vibration ring disclosed by the present invention, the spherical vibration part and the enclosed vibration module act on the female's clitoris to avoid pressing on other parts of the body, which increases the comfortableness in wearing the vibration ring and forms the better exciting effect in vibration. Even more, by the jumping of the ball or by the swinging resulted from the vibration motor, the irregular exciting effect can be formed at the area of contact, thereby increasing the sense of excitement to the users in a more aggressive and reliable means.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A vibration ring comprising:

a vibration module including at least a battery, a circuit board and a vibration motor connected electrically in a spherical shell, and a switch exposed out of the shell and connected electrically with the circuit board; and a latex ring made of latex and a spherical vibration part enclosing the shell of the vibration module;

wherein the switch controls an ON/OFF of a circuit between the vibration motor and the battery, and changes a vibration mode and a vibration frequency that the circuit board uses to drive the vibration motor through a user touching the switch repeatedly, wherein the vibration motor swings freely, with an end of the vibration motor being connected with the circuit board to form a pivot; the vibration motor rotating up-and-down alternatingly relative to the circuit board against the pivot to hit the shell repeatedly.

2. The vibration ring according to claim 1, wherein the vibration module is provided with at least a ball inside the shell, wherein the ball jumps in the shell by an action of the vibration motor.

3. The vibration ring according to claim 2, wherein for the vibration module, the circuit board is connected electrically with at least a light emitting diode, wherein the spherical shell is a spherical ball formed from a transparent material, and the latex ring is processed with transparent latex.

4. The vibration ring according to claim 2, wherein for the latex ring, a side of the vibration part is provided with an opening and an aperture of the opening is smaller than an outer diameter of the shell.

5. The vibration ring according to claim 2, wherein for the vibration module, the circuit board is connected electrically with at least a light emitting diode, wherein the spherical shell is a spherical ball formed from a transparent material, the latex ring is processed with transparent latex, a side of the vibration part is provided with an opening, and an aperture of the opening is smaller than an outer diameter of the shell.

6. The vibration ring according to claim 2, wherein the vibration part includes a plurality of columns disposed outside thereof.

7. The vibration ring according to claim 6, wherein the columns are thick columns and thin columns that are distributed alternatingly.

8. The vibration ring according to claim 2, wherein the latex ring is provided with a hook part.

* * * * *